US011753835B1

(12) United States Patent
LaMont

(10) Patent No.: US 11,753,835 B1
(45) Date of Patent: Sep. 12, 2023

(54) APPARATUSES, SYSTEMS, AND METHODS TO PLUMB A WOOD FRAMED WALL

(71) Applicant: Matthew J. LaMont, Salmon, ID (US)

(72) Inventor: Matthew J. LaMont, Salmon, ID (US)

( * ) Notice: Subject to any disclaimer, the term of this patent is extended or adjusted under 35 U.S.C. 154(b) by 0 days.

(21) Appl. No.: 18/170,280

(22) Filed: Feb. 16, 2023

(51) Int. Cl.
*E04G 21/18* (2006.01)

(52) U.S. Cl.
CPC ..... *E04G 21/1841* (2013.01)

(58) Field of Classification Search
CPC ..... E04G 21/1841
USPC ..... 33/518, 404, 613, 645, 286; 52/127.2, 52/745.12
See application file for complete search history.

(56) References Cited

U.S. PATENT DOCUMENTS 3,574,981 A * 4/1971 Henschen ..... E04G 21/26 248/354.3
4,344,619 A * 8/1982 Szabo ..... A63B 21/0615 248/161
5,134,907 A * 8/1992 Branson ..... E04F 21/22 81/46
6,247,273 B1 * 6/2001 Nickel ..... E04G 21/26 248/240.2
6,439,542 B2 * 8/2002 Gjerde ..... B66F 15/00 254/131
9,109,892 B2 * 8/2015 Carbajal ..... G01C 15/10
11,686,567 * 6/2023 Lowe ..... E04F 21/00 33/613
2001/0025950 A1 * 10/2001 Gjerde ..... E04G 23/08 254/25
2003/0071249 A1 * 4/2003 Clemons ..... B66F 15/00 254/17
2007/0175174 A1 * 8/2007 Bruno ..... E04G 21/26 52/745.12
2013/0340267 A1 * 12/2013 Carbajal ..... G01C 15/004 33/286

* cited by examiner

*Primary Examiner* — Yaritza Guadalupe-McCall
(74) *Attorney, Agent, or Firm* — PARSONS BEHLE & LATIMER

(57) ABSTRACT

Apparatus, systems, and methods to vertically plumb a wood framed wall. The apparatus includes a handle portion, a beam portion is connected to the handle portion, and a base plate pivotally connected the beam portion. The apparatus includes one or more apertures in both the beam portion and the base plate. The apparatus may include a flange that extends from the base plate with one or more apertures in the flange. The handle portion may have a circular cross-section and may be integrally formed with the beam portion. The beam portion of the apparatus may be pivotally connected to the base plate by a clevis and a pin. Fasteners connect the beam portion to a brace of a wood framed wall and the base plate to the floor or a base plate. A force may be applied to the handle to vertically plumb the wood framed wall.

20 Claims, 5 Drawing Sheets

APPARATUSES, SYSTEMS, AND METHODS TO PLUMB A WOOD FRAMED WALL

FIELD OF THE DISCLOSURE

The embodiments described herein relate to apparatuses, systems, and methods for plumbing a wood framed wall.

BACKGROUND

Description of the Related Art

A wood framed wall is often constructed on the ground, or elsewhere, and then moved to a location upon where the wood framed wall may be raised and secured to a wall. Often a force has to be applied to the wood framed wall to ensure that the wood framed wall is vertically plumb with the wall to which is it to be secured. One prior method to attempt to vertically plumb a wood framed wall would be to use a wooden 2×4 connected to a brace and a wooden block on the floor to apply a force on the wood framed wall to move it to a vertically plump position. There are a number of disadvantages with this method. For example, the larger the wall the larger the force needed to apply to the wooden 2×4, which may cause the 2×4 to break. A screw may be used to temporarily attach the wooden 2×4 to the brace, which may cause the 2×4 to split weakening the strength of the 2×4. A wooden 2×4 also is not shaped to provide an ergonomically designed grip for the user's hand, which may cause discomfort and/or limit the amount of force that may be applied to the wooden 2×4. Other disadvantages exist.

SUMMARY

The present disclosure is directed to apparatuses, systems, and methods for vertically plumbing a wood framed wall with a structure.

An embodiment of the disclosure is an apparatus to vertically plumb a wood framed wall. The apparatus comprises a handle portion having a first end and a second end. The apparatus includes a beam portion having a first end and a second end. The first end of the beam portion is connected to the second end of the handle portion. The apparatus includes a base plate having a first end and a second end. The second end of the beam portion is pivotally connected to the base plate. The apparatus includes one or more apertures in the beam portion and one or more apertures in the base plate.

The apparatus may include a flange that extends from the base plate. There may be an angle of approximately ninety degrees between the flange and the base plate. The apparatus may include one or more apertures in the flange. The apparatus may include a handle portion that has a circular cross-section. The handle portion may be integrally formed with the beam portion. The circular cross-section of the handle portion may have a diameter and wherein the beam portion may have a width with the width of the beam portion being larger than the diameter of the handle portion.

The beam portion of the apparatus may be pivotally connected to the base plate by a clevis and a pin. The pin may be a bolt and a fastener. The handle portion, the beam portion, and the base plate may be comprised of steel, aluminum, or a composite material. The apparatus may include a grip. The grip may be positioned on the handle portion. The apparatus may include at least five apertures in the beam portion.

An embodiment of the disclosure is a system to vertically plumb a wood framed wall. The system includes a wood framed wall. The wood framed wall having a top plate, a bottom plate, and a plurality of vertical members connected between the top plate and the bottom plate. The system includes a brace connected diagonally across the wood framed wall. The system includes a beam portion having a first end, a second end, and at least one aperture through the beam. The system includes a first fastener connects the beam portion to the brace through the at least one aperture. The system includes a base plate pivotally connected to the second end of the beam portion. The system includes a handle connected to the first end of the beam portion.

The system may include at least one aperture through the base plate and a second fastener connects the base plate to a floor portion. The handle may have a circular cross section. The system may include a grip positioned on at least a portion of the handle. The system may include a flange connected to an edge of the base plate. The flange may extend substantially perpendicular from the base plate. The system may include at least one aperture through the flange. The system may include a second fastener that connects the flange to the bottom plate of the wood framed wall.

An embodiment of the disclosure is a method to plumb a wood framed wall. The method includes connecting a beam portion to a brace connected to the wood framed wall. The beam portion includes a first end and a second end. The beam portion is connected to the wood framed wall by a first fastener inserted through an aperture in the beam portion. The method includes connecting a base plate to a structure. The base plate is pivotally connected to the second end of the beam portion. The method includes applying a force to a handle portion to plumb the wood framed wall. The handle portion is connected to the first end of the beam portion.

Connecting the base plate to the structure may include securing the base plate to a floor portion by inserting a second fastener through an aperture in the base plate. Connecting the base plate to the structure may include inserting a second fastener through an aperture in a flange into a floor plate of the wood framed wall, wherein the flange extends substantially perpendicular from the base plate.

Additional embodiments exist.

Figure 1:
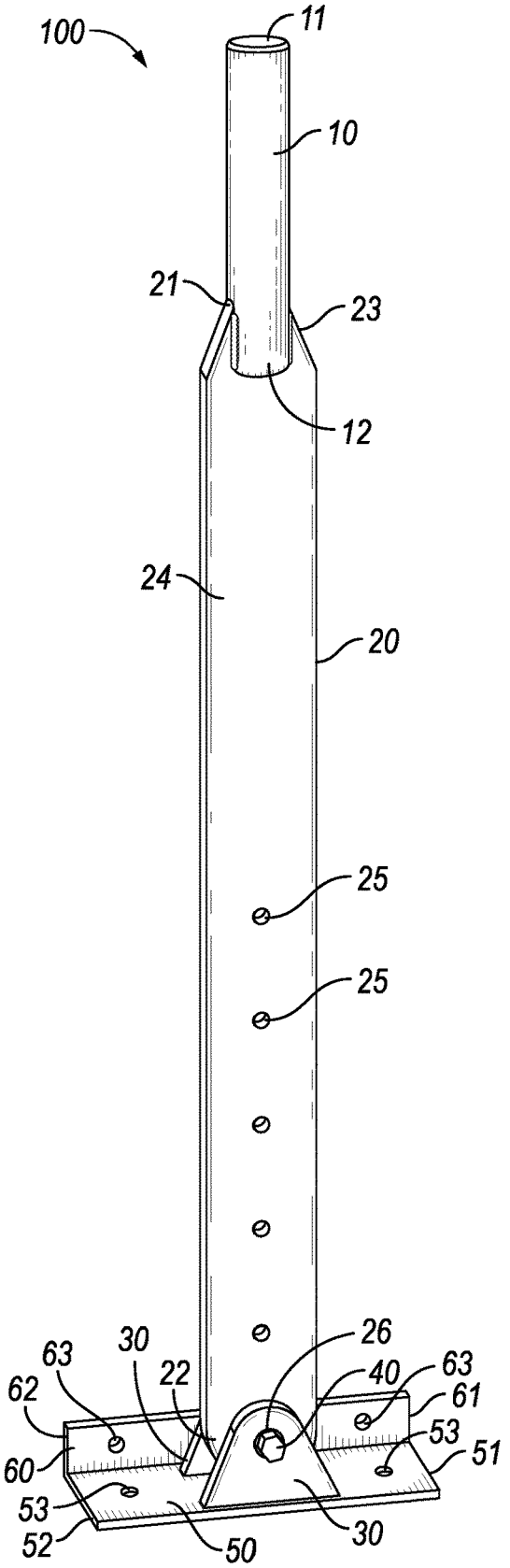
FIG. 1 shows an embodiment of an apparatus that may be used to plumb a wood framed wall.

While the disclosure is susceptible to various modifications and alternative forms, specific embodiments have been shown by way of example in the drawings and will be described in detail herein. However, it should be understood that the disclosure is not intended to be limited to the particular forms disclosed. Rather, the intention is to cover all modifications, equivalents and alternatives falling within the scope of the invention as defined by the appended claims.

DETAILED DESCRIPTION

Figure 7:
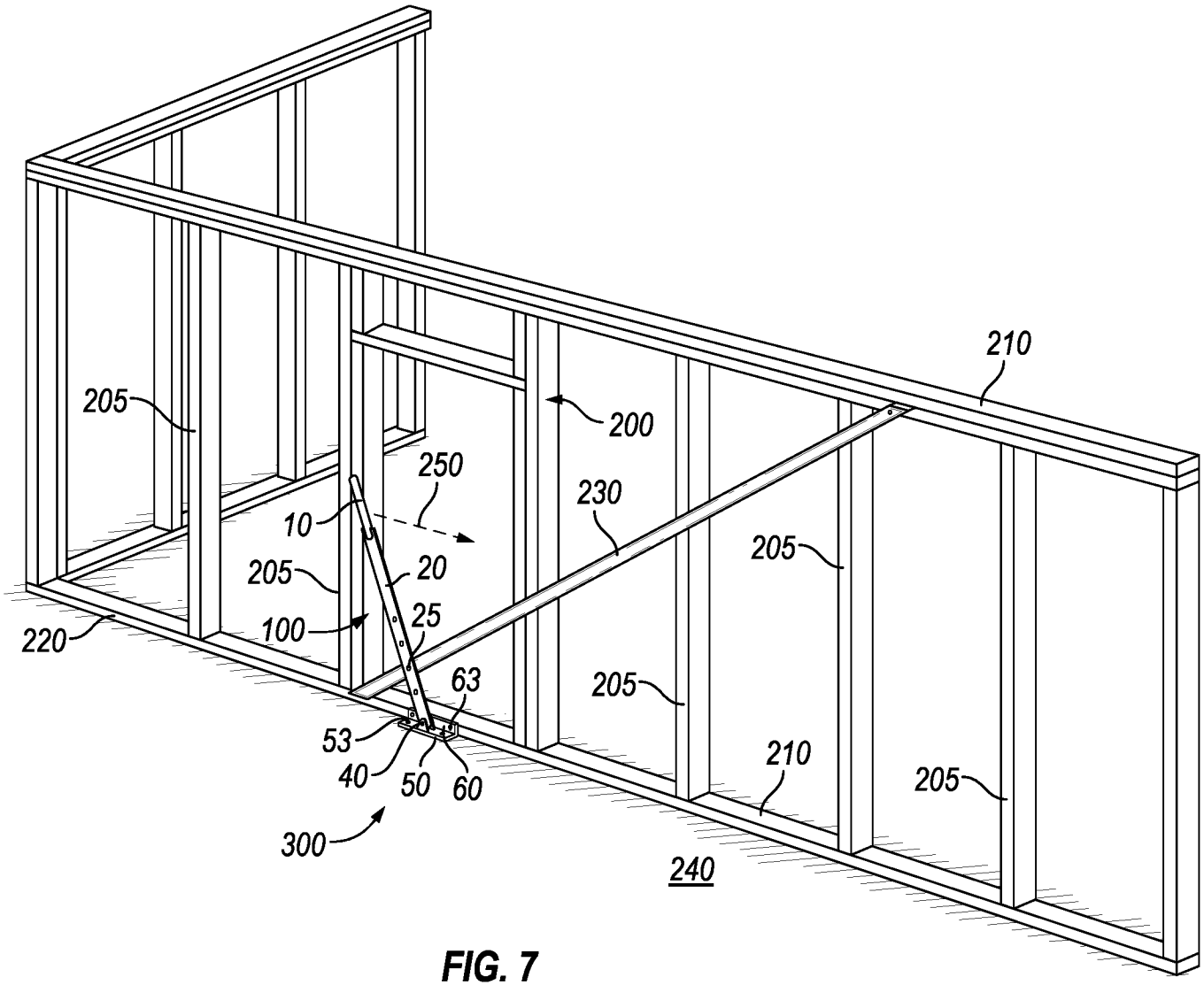
FIG. 7 shows an embodiment of a system to plumb a wood framed wall.

FIG. 1 shows an apparatus 100 that may be used to vertically plumb a wood framed wall 200 (shown in FIG. 7). The apparatus 100 includes a handle portion 10. The handle portion has a first end 11 and a second end 12. The apparatus 100 includes a beam portion 20. The beam portion 20 has a first end 21 and a second end 22. The first end 21 of the beam portion 20 is connected to the second end 12 of the handle portion 10. The handle portion 10 may be connected to the beam portion 20 by various mechanisms as would be appreciated by one of ordinary skill in the art having the benefit of this disclosure. For example, the handle portion 10 may be welded to the beam portion 20. Alternatively, one or more fasteners could be used to connect the handle portion 10 to the beam portion 20. The handle portion 10 may be integral with the beam portion 20.

The apparatus 100 includes a base plate 50. The base plate 50 has a first end 51 and a second end 52. The second end 22 of the beam portion 20 is pivotally connected to the base plate 50. The apparatus 100 includes one or more apertures 25 in the beam portion 20. Fasteners 90A (shown in FIG. 6) may be positioned in one or more apertures 25 of the beam portion 20 to selectively secure or connect the beam portion 20 to a brace 230 (shown in FIG. 7) as discussed herein. The apparatus 100 includes and one or more apertures 53 in the base plate 50. Fasteners 90B (shown in FIG. 5) may be positioned in one or more apertures 53 in the base plate 50 to selectively secure or connect the base plate 50 to a floor 240 (shown in FIG. 7) as discussed herein.

The apparatus 100 includes a flange 60 that extends from the base plate 50. There is an angle of approximately ninety degrees between the flange 60 and the base plate 50. The apparatus 100 includes one or more apertures 63 in the flange 60. Fasteners 90B (shown in FIG. 5) may be positioned in one or more apertures 63 in the flange 60 to selectively secure or connect the flange 60, and thus the base plate 50, to a bottom plate 220 (shown in FIG. 7) as discussed herein.

Figure 2:
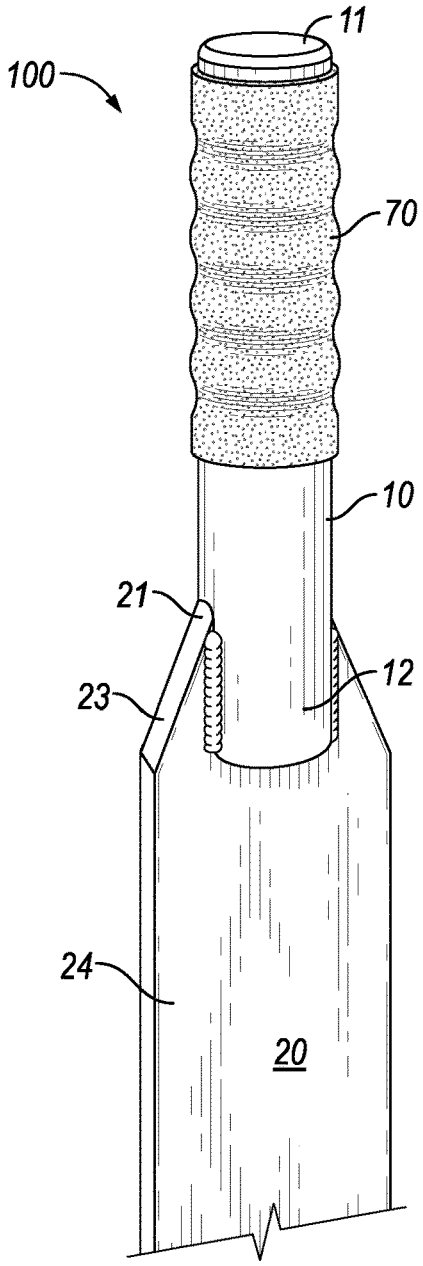
FIG. 2 shows a portion of an embodiment of an apparatus that may be used to plumb a wood framed wall.

The handle portion 10 of the apparatus 100 may have a circular cross-section. The handle portion 10 may be integrally formed with the beam portion 20. The circular cross-section of the handle portion may have a diameter that is less than the width of beam portion 20 as shown in FIG. 2. The apparatus 100 may include a grip 70 positioned on the handle portion 10. The grip 70 (shown in FIG. 2) may be comprised of rubber, plastic, or the like, to provide a user with a comfortable portion to hold the handle portion 10.

The beam portion 20 of the apparatus 100 is pivotally connected to the base plate 50. There are various mechanisms that may be used to pivotally connect the second end 22 of the beam portion 20 to the base plate 50 as would be appreciated by one of ordinary skill in the art having the benefit of this disclosure. For example, a clevis 30 and a pin may be used to pivotally connect the second end 22 of the beam portion 20 to the base plate 50. The pin may be a bolt 40 and a fastener 41. The handle portion 10, the beam portion 20, and the base plate 50 may be comprised of steel, aluminum, composite material, or the like. The apparatus 100 may include at least five apertures 25 in the beam portion 20. The beam portion 20 may include a tapered section 23 at the first end 21 of the beam portion 20 to transition from the larger width of the beam portion 20 to the smaller diameter of the handle portion 10.

FIG. 2 shows a portion of the apparatus 100 that may be used to plumb a wood framed wall. The second end 12 of the handle portion 10 may be welded to the first end 21 of the beam portion 20. The first end 21 of the beam portion 20 may include a tapered section 23 that tapers from a middle section 24 having a larger width than the diameter of the handle portion 10.

Figure 3:
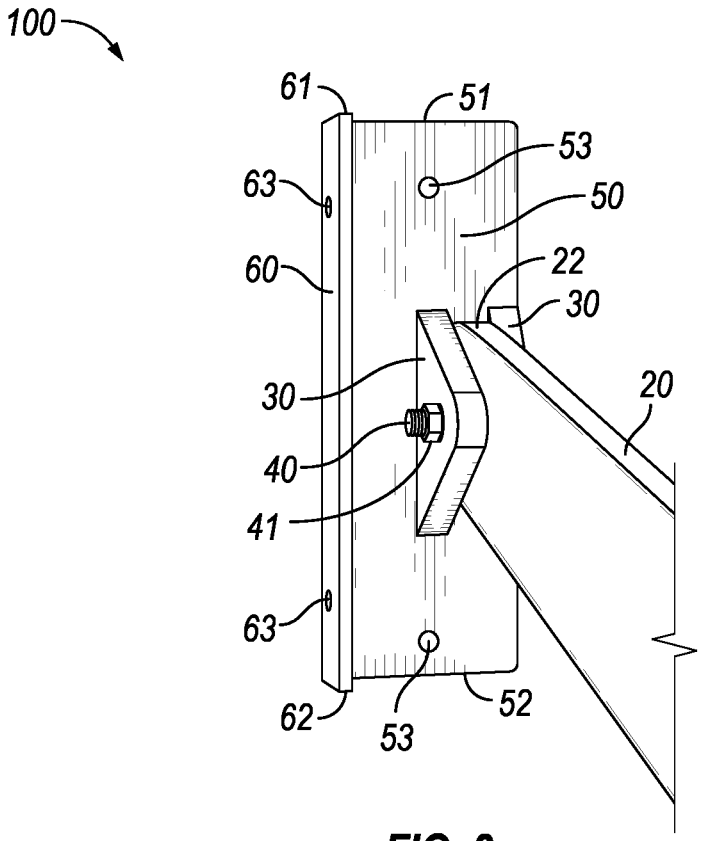
FIG. 3 shows a portion of an embodiment of an apparatus that may be used to plumb a wood framed wall.
Figure 5:
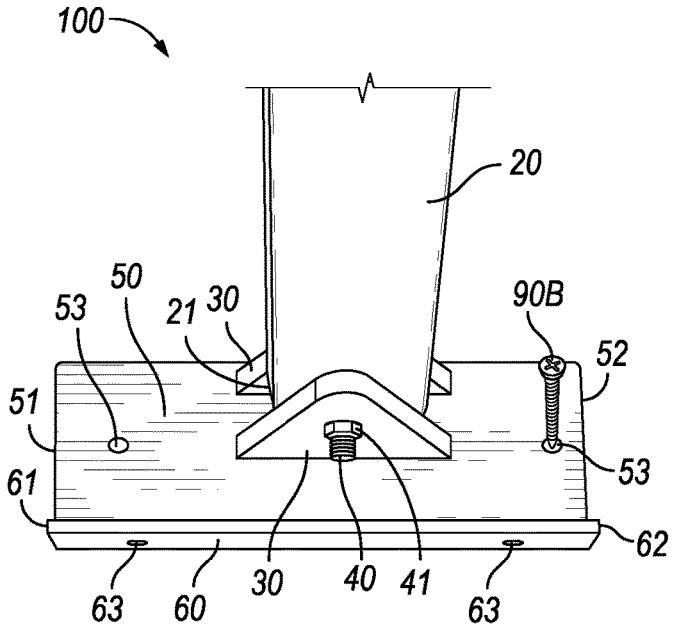
FIG. 5 shows a portion of an embodiment of an apparatus that may be used to plumb a wood framed wall.

FIGS. 3 and 5 shows that the base plate 50 is pivotally connected to the second end 22 of the beam portion 20. A bolt 40 is positioned through a hole, or aperture, 26 (shown in FIG. 1) in the second end 22 of the beam portion 20 and a clevis 30. A nut, or fastener, 41 is used to secure the bolt 40 in place. The base plate 50 includes a first end 51 and a second end 52. The base plate 50 includes one or more apertures 53 through the base plate 50. A flange 60 extends from the base plate 50. The flange 60 includes a first end 61, a second end 62, and one or more apertures 63 through the flange 60. The flange 60 and base plate 50 may form a substantially ninety (90) degree angle between the base plate 50 and the flange 60.

A fastener, or screw, 90B (shown in FIG. 5) may be used to selectively secure the base plate 50 to the floor 240. Once the base plate 50 of the apparatus 100 is selectively connected to the floor and the beam portion 20 is selectively connected to a brace 230 via a fastener through an aperture 25, the apparatus 100 may be used to vertically plumb the wood framed wall 200 by exerting a force 250 (shown in FIG. 7) on the handle portion 10 to move the wood framed wall 200 into a vertically plumbed position.

Figure 4:
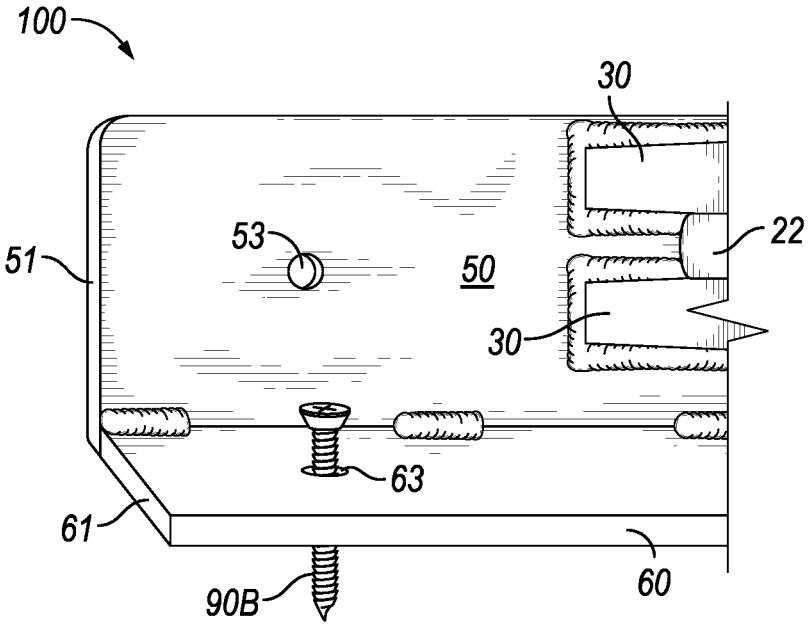
FIG. 4 shows a portion of an embodiment of an apparatus that may be used to plumb a wood framed wall.

FIG. 4 shows a portion of the base plate 50 and flange 60 of the apparatus 100. A fastener, or screw, 90B may be used to selectively secure the flange 60, and thus the base plate 50, to the bottom plate 220 (shown in FIG. 7) of a wood framed wall (shown in FIG. 7). Once the flange 60 of the apparatus 100 is selectively connected to the bottom plate 220 and the beam portion 20 is selectively connected to a brace 230 via a fastener through an aperture 25, the apparatus 100 may be used to vertically plumb the wood framed wall 200 by exerting a force 250 (shown in FIG. 7) on the handle portion 10 to move the wood framed wall 200 into a vertically plumbed position.

Figure 6:
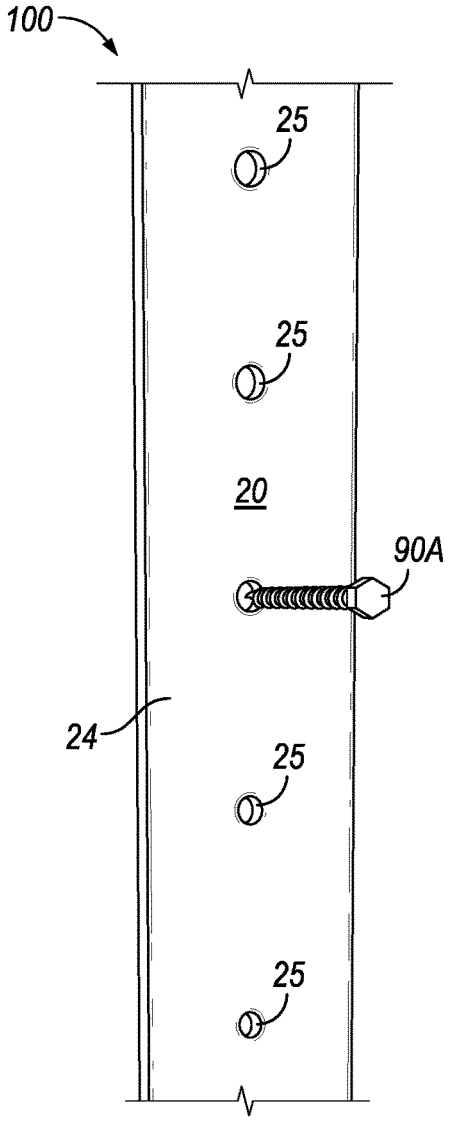
FIG. 6 shows a portion of an embodiment of an apparatus that may be used to plumb a wood framed wall.

FIG. 6 shows a portion 24 of the beam portion 20 of the apparatus 100. A portion 24 of the beam portion 20 may include at least five apertures 25 through the beam portion 20. A fastener, or screw, 90A may be used to connect the beam portion 20 to a brace 230 of a wood framed wall 200. With the beam portion 20 connected to the brace 230 and the base plate 50 connected to a structure (i.e., floor 240 or bottom plate 220) the apparatus 100 may be used to vertically plumb the wood framed wall 200 by applying a force 250 on the handle portion 10 of the apparatus 100 to move the wood framed wall 200 to be vertically plumb with an adjacent structure. FIG. 6 shows five (5) apertures 25 for illustrative purposes as the number may be more or less than five (5) as would be appreciated by one of ordinary skill in the art having the benefit of this disclosure. Having multiple apertures 25 through the beam portion 20 of the apparatus 100 may enable a user to adjust the angle relative to the floor 240 at which the apparatus 100 is connected to the brace 230 of the wood framed wall 200.

FIG. 7 shows a system 300 to vertically plumb a wood framed wall 200. The system 300 includes a wood framed wall 200 and an apparatus 100. The wood framed wall 200 includes a top plate 210, a bottom plate 220, and a plurality of vertical members 205 connected between the top plate 210 and the bottom plate 220. The configuration of the top plate 210, bottom plate 220, and location and number of vertical members 205 is shown for illustrative purposes and may be varied as would be appreciated by one of ordinary skill in the art having the benefit of this disclosure.

The system 300 includes a brace 230 connected diagonally across the wood framed wall 200. The brace 230 may be connected at one end to the top plate 210 and may be connected to the bottom plate 220 at the other end. The system 300 includes an apparatus 100 having a beam 20. The beam 20 has a first end 21, a second end 22, and at least one aperture 25 through the beam 20. The system 300 includes a first fastener 90A (shown in FIG. 6) that selectively connects the beam 20 of the apparatus 100 to the brace 230 through the at least one aperture 25. The system 300 includes a base plate 50 pivotally connected to the second end 22 of the beam 20. The system 300 includes a handle 10 connected to the first end 21 of the beam 20.

The system 300 includes at least one aperture 53 through the base plate 50 and a second fastener 90B (shown in FIG. 5) that selectively connects the base plate 50 to a floor 240. After the beam 20 is connected to the brace 230 and the base plate 50 is connected to the floor 240, a force 250 may be applied to the handle 10 to vertically plumb the wood framed wall 200 to an adjacent structure.

As discussed herein, the handle 10 may have a circular cross section and the system 300 may include a grip 70 positioned on at least a portion of the handle 10. The apparatus 100 of the system 300 includes a flange 60 connected to an edge of the base plate 50. The flange 60 may extend substantially perpendicular from the base plate 50. The flange 60 includes at least one aperture 63 through the flange. A second fastener 90B (shown in FIG. 4) may selectively connect the flange 60 to the bottom plate 220 of the wood framed wall 200. After the beam 20 is connected to the brace 230 and the flange 60 is connected to the bottom plate 220, a force 250 may be applied to the handle 10 to vertically plumb the wood framed wall 200 to an adjacent structure.

Figure 8:
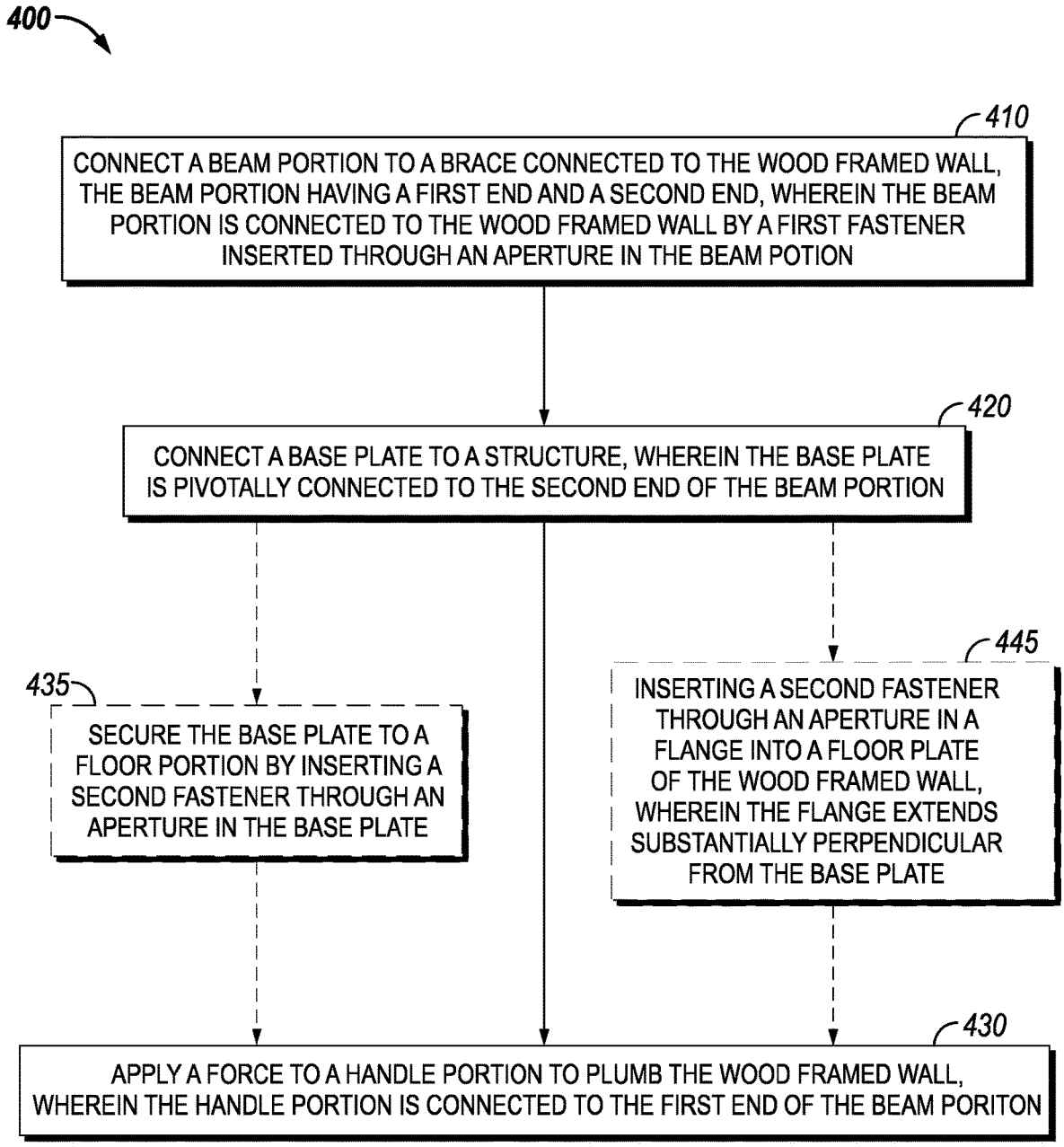
FIG. 8 shows a flow chart of an embodiment of a method for plumbing a wood framed wall.

FIG. 8 is a flow chart of a method 400 to plumb a wood framed wall. The method 400 includes connecting a beam portion 20 to a brace 230 connected to the wood framed wall 200, at 410. The beam portion 20 includes a first end 21 and a second end 22. The beam portion 20 is connected to the wood framed wall 200 by a first fastener 90A inserted through an aperture 25 in the beam portion 20. The method 400 includes connecting a base plate 500 to a structure, at 420. The base plate 50 is pivotally connected to the second end 22 of the beam portion 20. The method 400 includes applying a force 250 to a handle portion 10 to plumb the wood framed wall 200, at 430. The handle portion 10 is connected to the first end 21 of the beam portion 20.

Connecting the base plate 50 to the structure may include securing the base plate 50 to a floor portion 430 by inserting a second fastener 90B through an aperture 53 in the base plate 50, at 435. Connecting the base plate 50 to the structure may include inserting a second fastener 90B through an aperture 63 in a flange 60 into a floor plate 220 of the wood framed wall 200, wherein the flange 60 extends substantially perpendicular from the base plate 50, at 445.

Although this disclosure has been described in terms of certain preferred embodiments, other embodiments that are apparent to those of ordinary skill in the art, including embodiments that do not provide all of the features and advantages set forth herein, are also within the scope of this disclosure. Accordingly, the scope of the present disclosure is defined only by reference to the appended claims and equivalents thereof.

What is claimed is:

1. An apparatus to vertically plumb a wood framed wall, the apparatus comprising:
- a handle portion having a first end and a second end;
- a beam portion having a first end and a second end, the first end of the beam portion being connected to the second end of the handle portion;
- a base plate having a first end and a second end, wherein the second end of the beam portion is pivotally connected to the base plate;
- one or more apertures in the beam portion;
- one or more apertures in the base plate;
- a flange that extends from the base plate, wherein there is an angle of approximately ninety degrees between the flange and the base plate;
- a clevis connected to the base plate; and
- and a pin, wherein the beam portion is pivotally connected to the base plate by the clevis and the pin.

2. The apparatus of claim 1, further comprising a gap between the flange and the clevis.

3. The apparatus of claim 2, further comprising one or more apertures in the flange.

4. The apparatus of claim 3, wherein the handle portion has a circular cross-section and wherein the handle portion is integrally formed with the beam portion.

5. The apparatus of claim 4, wherein the circular cross-section of the handle portion has a diameter, wherein the beam portion has a width, and wherein the width of the beam portion is larger than the diameter of the handle portion.

6. The apparatus of claim 5, wherein the handle portion, the beam portion, and the base plate are comprised of steel, aluminum, or a composite material.

7. The apparatus of claim 6, further comprising a grip, wherein the grip is positioned on the handle portion.

8. The apparatus of claim 5, further comprising at least five apertures in the beam portion.

9. The apparatus of claim 1, wherein the pin further comprises a bolt and a fastener.

10. A system to vertically plumb a wood framed wall, the system comprising:
- the wood framed wall, the wood framed wall having a top plate, a bottom plate, and a plurality of vertical members connected between the top plate and the bottom plate;
- a brace connected diagonally across the wood framed wall;
- a beam portion having a first end, a second end, and at least one aperture through the beam;
- a first fastener connects the beam portion to the brace through the at least one aperture;
- a base plate pivotally connected to the second end of the beam portion; and
- a handle connected to the first end of the beam portion.

11. The system of claim 10, further comprising:
- at least one aperture through the base plate; and
- a second fastener connects the base plate to a floor portion.

12. The system of claim 11, wherein the handle has a circular cross section.

13. The system of claim 12, further comprising a grip positioned on at least a portion of the handle.

14. The system of claim 10, further comprising:
- a flange connected to an edge of the base plate, the flange extends substantially perpendicular from the base plate;

at least one aperture through the flange; and a second fastener that connects the flange to the bottom plate of the wood framed wall.

15. The system of claim 14, wherein the handle has a circular cross section.

16. The system of claim 15, further comprising a grip positioned on at least a portion of the handle.

17. The system of claim 10, wherein the wood framed wall has a length and wherein the beam portion pivots with respect to the base plate along an axis that is perpendicular to the length of the wood framed wall.

18. A method to plumb a wood framed wall, the method comprising:

connecting a beam portion to a brace connected diagonally across the wood framed wall, the beam portion having a first end and a second end, wherein the beam portion is connected to the brace by a first fastener inserted through an aperture in the beam portion;

connecting a base plate to a structure, wherein the base plate is pivotally connected to the second end of the beam portion; and applying a force to a handle portion to plumb the wood framed wall, wherein the handle portion is connected to the first end of the beam portion and wherein the force is parallel to the wood framed wall.

19. The method of claim 18, wherein connecting the base plate to the structure further comprises securing the base plate to a floor portion by inserting a second fastener through an aperture in the base plate.

20. The method of claim 18, wherein connecting the base plate to the structure further comprises inserting a second fastener through an aperture in a flange into a floor plate of the wood framed wall, wherein the flange extends substantially perpendicular from the base plate.

* * * * *